US010514639B2

(12) United States Patent
Kawasaki et al.

(10) Patent No.: US 10,514,639 B2
(45) Date of Patent: Dec. 24, 2019

(54) HEATING UNIT, FIXING DEVICE, AND IMAGE FORMING APPARATUS

(71) Applicant: KYOCERA Document Solutions Inc., Osaka (JP)

(72) Inventors: Hiroki Kawasaki, Osaka (JP); Takashi Eiki, Osaka (JP); Kotatsu Kawaguchi, Osaka (JP); Ryohei Tokunaga, Osaka (JP); Atsushi Kohama, Osaka (JP); Yuhiro Sakai, Osaka (JP); Sadanori Nakae, Osaka (JP); Yuta Kitabayashi, Osaka (JP); Shunsaku Fujii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/183,915

(22) Filed: Nov. 8, 2018

(65) Prior Publication Data

US 2019/0146388 A1 May 16, 2019

(30) Foreign Application Priority Data

Nov. 14, 2017 (JP) ..... 2017-219175
Jul. 10, 2018 (JP) ..... 2018-130890

(51) Int. Cl.
*G03G 15/20* (2006.01)
*H05B 3/26* (2006.01)

(52) U.S. Cl.
CPC ..... *G03G 15/2042* (2013.01); *G03G 15/2053* (2013.01); *G03G 15/2064* (2013.01); *H05B 3/26* (2013.01); *H05B 2203/007* (2013.01); *H05B 2203/035* (2013.01)

(58) Field of Classification Search
CPC ..... G03G 15/2039–2053
See application file for complete search history.

(56) References Cited

U.S. PATENT DOCUMENTS 4,774,492 A * 9/1988 Shier ..... H01C 17/23 219/121.69
5,391,861 A * 2/1995 Ooyama ..... G03G 15/2014 219/216
6,084,208 A * 7/2000 Okuda ..... G03G 15/2064 219/216
9,354,570 B2 5/2016 Arimoto et al.
2015/0341985 A1* 11/2015 Nakayama ..... G03G 15/2042 219/216

(Continued)

FOREIGN PATENT DOCUMENTS

JP 2016-62024 A 4/2016

*Primary Examiner* — Carla J Therrien
(74) *Attorney, Agent, or Firm* — Studebaker & Brackett PC

(57) ABSTRACT

A heating unit includes a circuit board, a plurality of heating parts, and a plurality of wiring parts. The heating parts are arranged in a first direction on a surface of the circuit board. The wiring parts are provided on the surface of the circuit board and electrically connect the heating parts and a power source to feed the heating parts. The wiring parts respectively include electrode terminal parts electrically connected to the power source outside the heating parts in the first direction. Sizes in a second direction orthogonal to the first direction of the heating parts are set to decrease gradually or stepwisely with separating in the first direction from the electrode terminal parts.

10 Claims, 12 Drawing Sheets

(56) References Cited

U.S. PATENT DOCUMENTS

2016/0018766 A1* 1/2016 Akiyama ..... G03G 15/206
399/333
2019/0056685 A1* 2/2019 Eiki ..... G03G 15/2053

* cited by examiner

HEATING UNIT, FIXING DEVICE, AND IMAGE FORMING APPARATUS

INCORPORATION BY REFERENCE

This application is based on and claims the benefit of priority from Japanese Patent applications No. 2017-219175 filed on Nov. 14, 2017, and No. 2018-130890 filed on Jul. 10, 2018; the entire contents of which are incorporated herein by reference.

BACKGROUND

The present disclosure relates to a heating unit, a fixing device, and an image forming apparatus.

An electrographic image forming apparatus includes a fixing device that thermally fixes toner on a medium.

For example, a heater of the fixing device is proposed. The heater has heating part that are arranged in a longer side direction and that generate heat when energized, and branching paths that are aligned at predetermined intervals in the longer side direction so as to energize the heating parts. The branching paths include first branching paths that diverge from conductive paths elongated from electrical contacts connected to one side of a power source, and second branching lines that diverge from the conductive paths at positions farther from the electrical contacts than the first branching paths. In the heater, resistance of the first branching lines is greater than that of the second branching lines, which restrains that heat generation decreases as farther from the electrical contacts under influence of a voltage drop due to electrical resistance of the conductive paths. In other words, uneven heating in the longer side direction of the heater is restrained by changing resistance of each branching line.

SUMMARY

In accordance with an aspect of the present disclosure, a heating unit includes a circuit board, a plurality of heating parts, and a plurality of wiring parts. The heating parts are arranged in a first direction on a surface of the circuit board. The wiring parts are provided on the surface of the circuit board and electrically connect the heating parts and a power source to feed the heating parts. The wiring parts respectively include electrode terminal parts electrically connected to the power source outside the heating parts in the first direction. Sizes in a second direction orthogonal to the first direction of the heating parts are set to decrease gradually or stepwisely with separating in the first direction from the electrode terminal parts.

In accordance with an aspect of the present disclosure, a fixing device includes a fixing member, a pressing member, and a heating unit. The fixing member heats toner on a medium with rotating around an axis thereof. The pressing member, with rotating around an axis thereof, forms a pressing area with the fixing member and press the toner on the medium passing through the pressing area. The heating unit is provided opposite to the pressing member across the fixing member and heats the fixing member. A diameter of the pressing member is set to decrease gradually from both ends in an axial direction toward a center. The heating unit includes a circuit board, a plurality of heating parts, and a plurality of wiring parts. The heating parts are arranged in the axial direction of the fixing member on a surface of the circuit board. The wiring parts are provided on the surface of the circuit board and electrically connect the heating parts and a power source to feed the heating parts. The wiring parts respectively include electrode terminal parts electrically connected to the power source outside the heating parts in the axial direction. Sizes in a passing direction orthogonal to the axial direction of the heating parts are set to decrease gradually or stepwisely from both ends in the axial direction toward a center in the axial direction. A size in the passing direction of a heating part located at another end in the axial direction is set to be smaller than a size in the passing direction of a heating part located at one end in the axial direction.

In accordance with an aspect of the present disclosure, an image forming apparatus includes the aforementioned fixing device.

The above and other objects, features, and advantages of the present disclosure will become more apparent from the following description when taken in conjunction with the accompanying drawings in which preferred embodiments of the present disclosure is shown by way of illustrative example.

DETAILED DESCRIPTION

Hereinafter, embodiments of the present disclosure will be explained with reference to attached figures. Arrows "Fr", "Rr", "L", "R", "U", and "D" shown in the figures respectively indicate a front side, a rear side, a left side, a right side, an upside, and a downside. Each figure shows each component with slight emphasis on characteristics thereof, and does not necessarily show accurate sizes.

Entire Configuration of Printer

Figure 1:
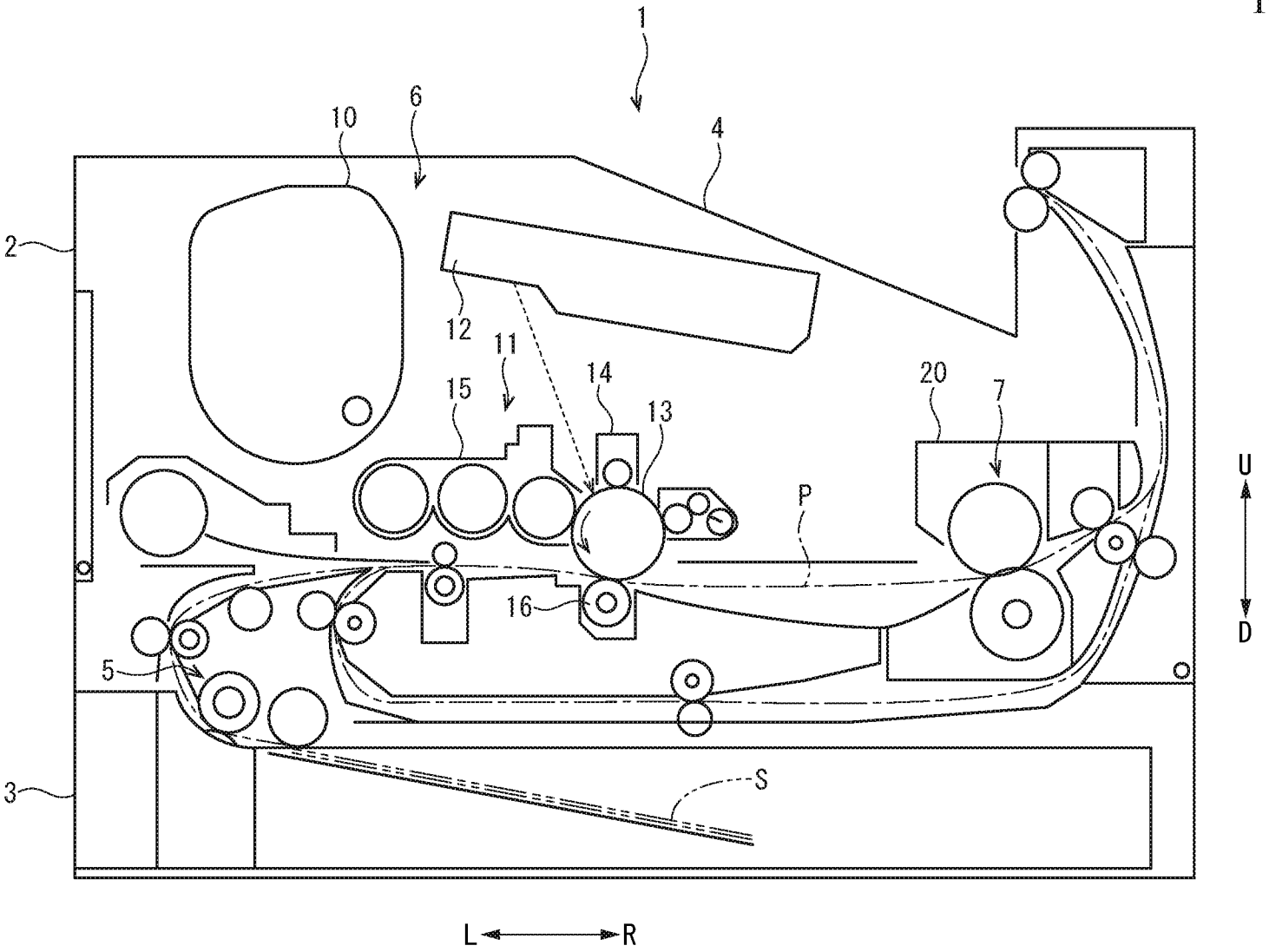
FIG. 1 is a schematic view (a front view) that shows a printer in accordance with a first embodiment of the present disclosure.

With reference to FIG. 1, a printer 1 as an example of an image forming apparatus will be described. FIG. 1 is a schematic view (a front view) that shows the printer 1.

The printer 1 includes main body 2 configuring a substantially rectangular parallelepiped-appearance. In a lower part of the main body 2, a sheet feeding cartridge 3 storing sheets S (i.e., media) such as plain papers is provided. In an upper surface of the main body 2, a sheet ejecting tray 4 is provided. The sheet S is not limited to the paper sheet and can be a resin sheet or the like.

The printer 1 includes a sheet feeding device 5, an imaging device 6, and a fixing device 7. The sheet feeding device 5 is provided at an upstream end of a conveying path P extending from the sheet feeding cartridge 3 to the sheet ejecting tray 4. The imaging device 6 is provided at an intermediate part of the conveying path P, and the fixing device 7 is provided at a downstream side of the conveying path P.

The imaging device 6 includes a toner container 10, a drum unit 11, and an optical scanning device 12. The toner container 10 contains, for example, black toner (i.e., developer). The drum unit 11 includes a photosensitive drum 13, a charger 14, a development device 15, and a transfer roller 16. The transfer roller 16 is in contact with a down side of the photosensitive drum 13 so as to form a transferring nip. The toner may be two-component developer obtained by mixing toner and carrier, or may be one-component developer composed of magnetic toner.

A control device (not shown) of the printer 1 appropriately controls each component so as to execute image forming process as follows. The charger 14 charges a surface of the photosensitive drum 13. The photosensitive drum 13 receives a scanning light emitted from the optical scanning device 12 and carries an electrostatic latent image. The development device 15 develops the electrostatic latent image on the photosensitive drum 13 to form a toner image using the toner supplied from the toner container 10. The sheet S is fed out by the sheet feeding device 5 from the sheet feeding cartridge 3 to the conveying path P. The toner image having been formed on the photosensitive drum 13 is transferred to the sheet S passing through the transferring nip. The fixing device 7 fixes the toner image on the sheet S. Afterward, the sheet S is ejected to the sheet ejecting tray 4.

First Embodiment: Fixing Device

Figure 2:
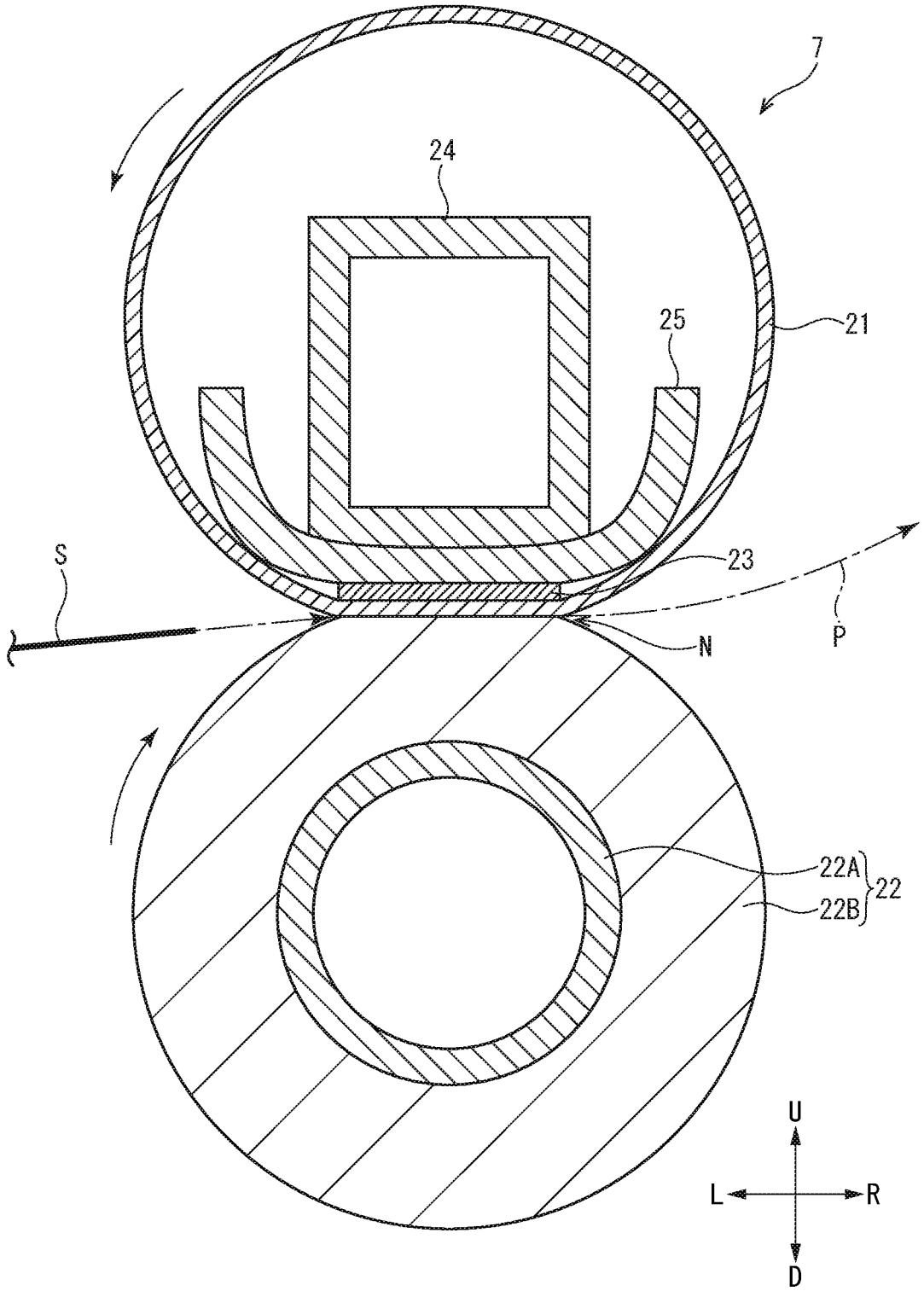
FIG. 2 is a sectional view that schematically shows a fixing device in accordance with the first embodiment of the present disclosure.
Figure 3:
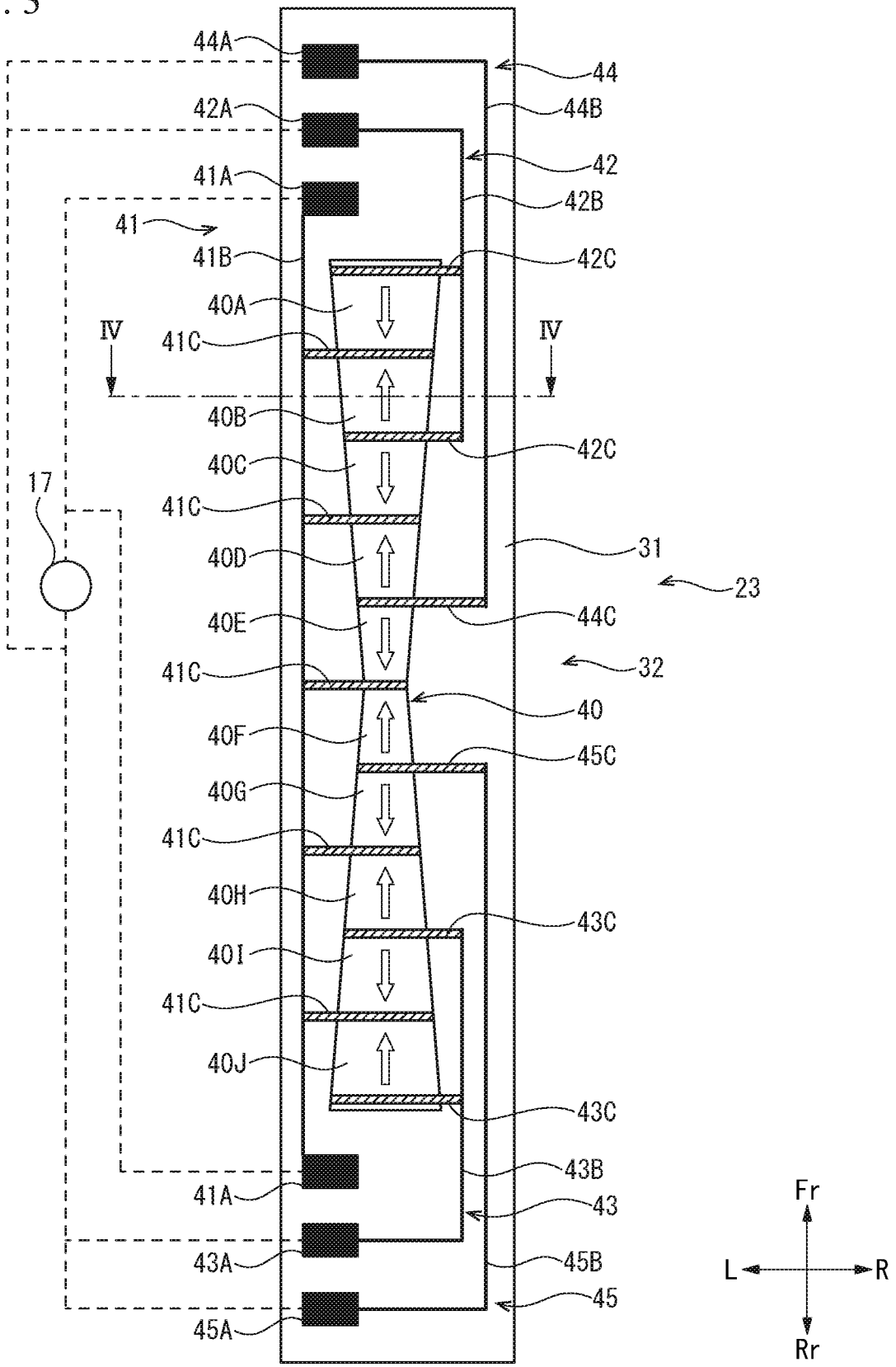
FIG. 3 is a bottom view that schematically shows a heater in accordance with the first embodiment of the present disclosure.
Figure 4:
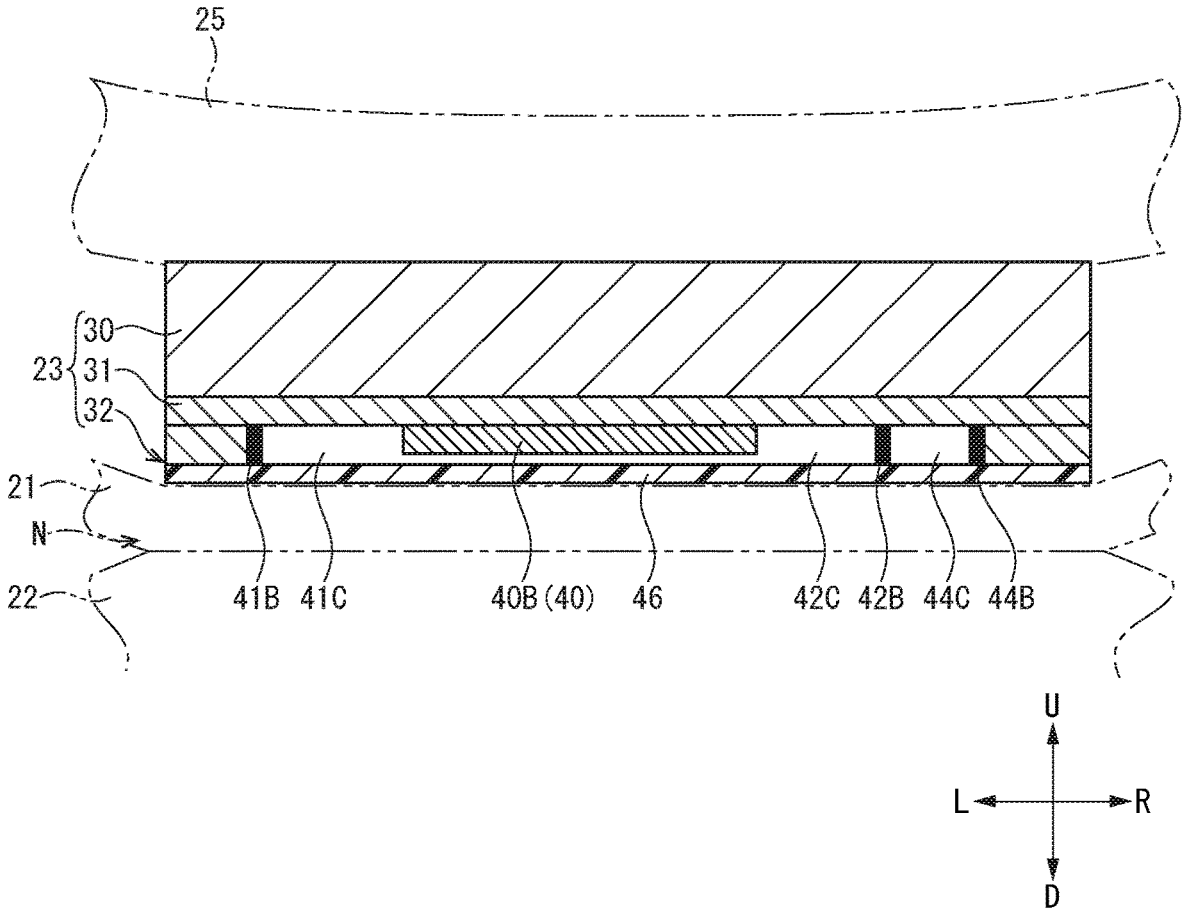
FIG. 4 is a sectional view along a line IV-IV of FIG. 3.
Figure 5:
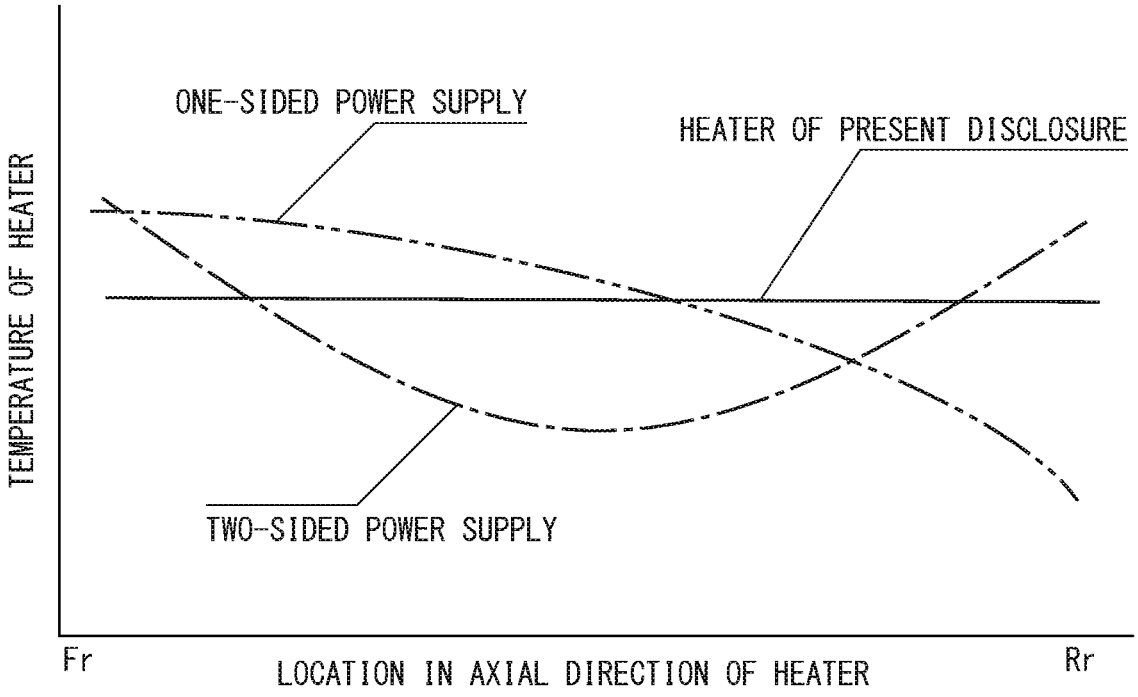
FIG. 5 is a graph that shows relation between temperature and location in an axial direction of the heater.

Subsequently, the fixing device 7 in accordance with a first embodiment will be explained with reference to FIGS. 2 to 5. FIG. 2 is a sectional view that schematically shows the fixing device 7. FIG. 3 is a bottom view that schematically shows a heater 23. FIG. 4 is a sectional view along a line IV-IV of FIG. 3. FIG. 5 is a graph that shows relation between temperature and location in an axial direction of the heater 23.

As shown in FIG. 2, the fixing device 7 includes a fixing belt 21, a pressing roller 22, and a heater 23. The fixing belt 21 and the pressing roller 22 are provided in a housing 20 (cf. FIG. 1). The heater 23 is a heat source that heats the fixing belt 21.

Fixing Belt

The fixing belt 21, which is an example of a fixing member, is an endless belt that is a substantially cylindrical member being elongated in a front-back direction (i.e., an axial direction). For instance, a surface of the fixing belt 21 is made of a synthetic resin material that has heat resistance property and elasticity, such as a polyimide resin. The fixing belt 21 is located in an upper part of the housing 20. A pair of substantially cylindrical caps (not shown) are fitted at both ends in the axial direction of the fixing belt 21. A belt guide (not shown) that retains a substantially cylindrical form of the fixing belt 21 may be provided in the fixing belt 21.

A pressing member 24 is provided in the fixing belt 21. For instance, the pressing member 24 is made of a metallic material and is a substantially rectangular cylindrical member being elongated in the axial direction. The pressing member 24 passes through the fixing belt 21 (and the caps) in the axial direction and is supported by the housing 20. The above-described fixing belt 21 is supported rotatably with respect to the pressing member 24.

Pressing Roller

The pressing roller 22, which is an example of a pressing member, is a substantially cylindrical member being elongated in the front-back direction (i.e., the axial direction). A diameter (i.e., an outside diameter) of the pressing roller 22 is substantially uniform (i.e., substantially the same) in the axial direction. The pressing roller 22 is located in a down part of the housing 20. The pressing roller 22 includes a metallic core metal 22A and an elastic layer 22*b*, such as a silicone sponge, that is laminated on an outer peripheral surface of the core metal 22A. Both ends in the axial direction of the core metal 22A are rotatably supported by the housing 20. A driving motor (not shown) is connected to the core metal 22A via a gear train or the like. The pressing roller 22 is rotationally driven by the driving motor. The fixing device 7 includes a pressure adjusting part (not shown) that raises and lowers the pressing roller 22 so as to adjust contact pressure of the pressing roller 22 against the fixing belt 21. Pressing the pressing roller 22 against the fixing belt 21 causes to form a pressing area N between the fixing belt 21 and the pressing roller 22. The pressing area N is a region from a position upstream in a conveying direction of the sheet S in which the pressure is 0 Pa to a position downstream in the conveying direction of the sheet S in which the pressure returns to 0 Pa after passing through a position in which the pressure becomes a maximum.

Heater

The heater 23, which is an example of a heating unit, is a substantially rectangular plate-shaped member being elongated in the front-back direction (i.e., the axial direction). (cf. FIG. 3) The heater 23 is fixed beneath the pressing member 24 via a supporting member 25. For instance, the supporting member 25 is made of a heat resistant resin material and is a substantially half-cylindrical member being elongated in the axial direction. The supporting member 25 is incurvated along a lower inner surface of the fixing belt 21.

As shown in FIGS. 3 and 4, the heater 23 includes a base material 30, a heat insulation layer 31, and a heating and contacting part 32. The base material 30 is fixed on a lower surface of the supporting member 25. The heat insulation layer 31 is formed on a lower surface of the base material 30, which is integrated with the base material 30 so as to form a circuit board. The heating and contacting part 32 is formed on a lower surface of the heat insulation layer 31. In the present specification, a "passing direction (i.e., a second direction)" is a direction that is orthogonal to the axial direction (i.e., a first direction), and is a direction where the sheet S passes (i.e., is conveyed) through the pressing area N of the fixing device 7. Hereinafter, "upstream" and "downstream", and expressions being similar thereto respectively indicate "upstream" and "downstream" in the passing direction, and similar notions.

As shown in FIG. 4, the heater 23 is held beneath the supporting member 25 in which the heating and contacting part 32 is directed to the pressing roller 22 and the heating and contacting part 32 contacts to an inner surface of the fixing belt 21. The heater 23 supports the fixing belt 21 that is pressed by the pressing roller 22, so that the pressing area N is formed at a contacting part of the fixing belt 21 and the pressing roller 22. The heater 23 is provided opposite to the pressing roller 21 across the fixing belt 21 (see also FIG. 2), and has a function of heating the fixing belt 21. Besides, a temperature sensor (not shown) that detects surface temperature of the fixing belt 21 and/or temperature of the heater 23 is provided in the housing 20.

Base Material

As shown in FIGS. 3 and 4, for instance, the base material 30 is made of a material that has electrical insulating property, such as a ceramic, and is a substantially rectangular plate-shaped member being elongated in the axial direction. Both upper and lower surfaces of the base material 30 are formed substantially flat and smooth.

Heat Insulation Layer

The heat insulation layer 31 is laminated (formed) on one surface (an entire lower surface) of the base material 30. For instance, the heat insulation layer 31 is made of a material that has electrical insulating property and low thermal conductivity, such as a ceramic (a glass), and is formed on the base material. The heat insulation layer 31 has a function of restricting that heat generated at the heating and contacting part 32 is transferred to a side of the base material 30.

Heating and Contacting Part

The heating and contacting part 32 is laminated on a lower surface of the heat insulation layer 31. The heating and contacting part 32 includes a heating layer part 40, plural (e.g., five) wiring 41 to 45, and a coat layer 46.

(Heating Layer Part)

The heating layer part 40 is an electrical resistor that heats when energized, and laminated on the lower surface of the heat insulation layer 31 (cf. FIG. 4). The heating layer part 40 is made of a material (such as a metal) that has electrical conductivity with a resistance value that is higher than that of the wiring parts 41 to 45. As shown in FIG. 3, the heating layer part 40 has a shape narrowing in width of the passing direction gradually from both ends in the axial direction toward a center. The heating layer part 40 is front-back symmetrical with respect to the most constricted part at the center in the axial direction. For example, the heating layer part 40 has a length in the axial direction in which the entire area of the sheet S of A4 size (297 mm width) can be heated. Although details will be described later, the heating layer part 40 is partitioned into heating parts 40A to 40J that are arranged at substantially the same intervals in the axial direction.

(Wiring Part)

The wiring parts 41 to 45 are provided on the lower surface of the heat insulation layer 31 (cf. FIG. 4). The wiring parts 41 to 45 are made of a material (such as a metal) that has electrical conductivity (with a resistance value that is lower than that of the heating layer part 40). The wiring parts 41 to 45 are made of the same metallic material.

In detail, as shown in FIG. 3, the wiring parts 41 to 45 include a common wiring part 41 and four discrete wiring parts 42 to 45. The common wiring part 41 is mostly located on an upstream side (i.e., a left side (one side of the second direction)) of the heating layer part 40, and is commonly connected to the heating parts 40A to 40J from the upstream side of the heating layer part 40 (i.e., the heating parts 40A to 40J). The four discrete wiring part 42 to 45 are mostly located on a downstream side (i.e., a right side (another side of the second direction) of the heating layer part 40, and are discretely connected to the heating parts 40A to 40J from the downstream side of the heating layer part 40. With respect to explanations of the present specification that are common to the common wiring part 41 and the discrete wiring parts 42 to 45, they are merely stated as "wiring parts 41 to 45" therein.

The common wiring part 41 includes a pair of electrode terminal parts 41A, a conductive path 41B, and five branching paths 41C. The discrete wiring part 42, 43 respectively include electrode terminal parts 42A, 43A, conductive paths 42B, 43B, and couples of two opposite branching paths 42C, 43C. The discrete wiring parts 44, 45 include electrode terminal parts 44A, 45A, conductive paths 44B, 45B, and opposite branching paths 44C, 45C. The common wiring part 41 is front-back symmetrical with respect to the constricted part at the center in the axial direction of the heating layer part 40. Similarly, the discrete wiring part 42 and the discrete wiring part 43 are front-back symmetrical, and the discrete wiring part 44 and the discrete wiring part 45 are also front-back symmetrical.

The electrode terminal parts 41A to 45A sandwich the heating layer part 40 (i.e., the heating parts 40A to 40J) therebetween and are arranged on both outsides in the axial direction of the heating layer part 40. The pair of the electrode terminal parts 41A, the electrode terminal parts 42A, 43A, and the electrode terminal parts 44A, 45A are arranged in this order at substantially the same intervals from the heating layer part 40 toward outsides in the axial direction. The electrode terminal parts 42A, 44A are located further forward than the heating layer part 40, and the electrode terminal parts 43A, 45A are located further backward than the heating layer part 40. The electrode terminal parts 41A are electrically connected to one of terminals of a power source 17, and the electrode terminal parts 42A to 45A are electrically connected to another of the terminals of the power source 17. The driving motor and so forth are electrically connected via various driving circuits (not shown) to the power source 17. The power source 17, the driving motor, the temperature sensor, and so forth are electrically connected via various circuits to the control device of the printer 1 and appropriately controlled by the control device.

The conductive paths 41B to 45B connect the branching paths 41C to 45C that are elongated in the passing direction to be connected to the heating layer part 40 (i.e., the heating parts 40A to 40J) with the electrode terminal parts 41A to 45A. In detail, the conductive path 41B is provided on the upstream side (i.e., the left side) of the heating layer part 40 so as to connect the pair of the electrode terminal parts 41A. The conductive paths 42B to 45B are provided on the downstream side (i.e., the right side) of the heating layer part 40 to be elongated from the electrode terminal parts 42A to 45A toward the center (i.e., an interior) in the axial direction. The conductive paths 44B, 45B are located further rightward than the conductive paths 42B, 43B, and elongated further inward than the conductive paths 42B, 43B.

The five branching paths 41C are arranged at substantially the same intervals in the axial direction, and are elongated from the conductive path 41B over the heating layer part 40. The couples of the two opposite branching paths 42C, 43C are respectively elongated from intermediate parts and apical parts of the conductive paths 42B, 43B in the axial direction over the heating layer part 40. The opposite branching paths 44C, 45C are elongated from apical parts of the conductive paths 44B, 45B over the heating layer part 40.

The five branching paths 41C and the six opposite branching paths 42C to 45C are alternately laminated (i.e., arranged) at substantially regular intervals on the heating layer part 40 to dividedly form the ten heating parts 40A to 40J. That is, the five branching paths 41C and the six opposite branching paths 42C to 45C are connected to the heating layer part 40 so that the heating layer part 40 is partitioned into the ten heating parts 40A to 40J. The wiring parts 41 to 45 are provided corresponding to the ten heating parts 40A to 40J and function to electrically connect the heating parts 40A to 40J with the power source 17 that feeds the heating parts 40A to 40J.

(Heating Part)

The ten heating parts 40A to 40J are made of the same metallic material and provided on the lower surface of the heat insulation layer 31. The ten heating parts 40A to 40J are put in a row in this order from the front side toward the back side in the axial direction. Sizes of the ten heating parts 40A to 40J in the passing direction (i.e., the right-left direction) are set to gradually decrease with separating from the electrode terminal parts 41A to 45A (i.e., the both ends of the axial direction) in the axial direction (i.e., with leaving for the axial center). That is, the heating parts 40A to 40J constitute substantially trapezoidal shapes that narrow from the both sides in the axial direction toward the center thereof. For example, using the maximum length in the passing direction of the heating parts 40A, 40J as a base of 100%, a length of the passing direction at the axial center of the heating layer part 40 is set to approximately 98%. The heating parts 40D to 40G that are located near the axial center are provided corresponding to a range of a small (e.g., A5-sized) sheet S. All of the heating parts 40A to 40J are provided corresponding to a range of a regular (e.g., A4-sized) sheet S.

As shown in FIG. 4, the coat layer 46 covers the wiring parts 41 to 45 and the heating parts 40A to 40J. For example, the coat layer 46 is made of a material that has electrical insulating property and sliding frictional force being small for the fixing belt 21. The coat layer 46 has function to electrically protect the wiring parts 41 to 45 and so forth so as to prevent from a leakage and a short circuit. The coat layer 46 forms a surface that contacts with the inner surface of the fixing belt 21. Materials that have electrical insulating property such as the heat insulation layer 31 or the coat layer 46 are laminated on portions in which the heating layer part 40 or the wiring parts 41 to 45 are not laminated.

In order to manufacture the above-described heater 23, for instance, a film forming technology such as sputtering, a production technology of a printed-circuit board, or a screen printing technology, or any combination of these technologies can be used. For example, the heat insulation layer 31 and the heating and contacting part 32 (the heating layer part 40, the wiring parts 41 to 45, the coat layer 46) may be laminated on the base material 30 using the sputtering technology. Alternatively, the heat insulation layer 31 and the heating and contacting part 32 may be formed on the base material 30 by repeating processes of exposure, development, etching, delamination, lamination and so forth, using photolithographic masks used as the production technology of the printed-circuit board. The heat insulation layer 31 and the heating and contacting part 32 may be formed by applying (i.e., screen-printing) electrical insulation paint or electrically conductive paint to the base material 30. By using these manufacturing processes, the heat insulation layer 31 and the heating and contacting part 32 can be formed accurately.

Operation of Fixing Device

Hereinafter, operation of the fixing device 7 (i.e., fixing processing) will be explained with reference to FIGS. 1 to 3 and FIG. 5. A case using an A4-sized sheet S will be explained as an example.

Firstly, the control device executes driving control of the driving motor and the power source 17 (the heater 23). The pressing roller 22 is rotated by driving force of the driving motor, and the fixing belt 21 is rotated by following the pressing roller 22 (cf. solid lines in FIG. 2). The power source 17 applies voltage between the common wiring part 41 and the discrete wiring parts 42 to 45. Then, electric potential differences are generated between the branching paths 41C and the opposite branching paths 42C to 45C, which causes electric current flows in opposite directions at the heating parts 40A to 40J neighboring across each branching path 41C to 45C (cf. arrows in FIG. 3). Thereby the heating parts 40A to 40J are heated, so that a range corresponding to a normal size in the fixing belt 21 can be heated.

Electrical resistance in each of the conductive paths 42B to 45B increases with separating from each of the electrode terminal parts 42A to 45A, so that voltage impressed on each of the heating parts 40A to 40J decreases with separating from each of the electrode terminal parts 42A to 45A (i.e., a voltage drop occurs). Consequently, if all of the heating parts 40A to 40J are in the same size, a heating value in each of the heating parts 40A to 40J gradually decreases with separating from the electrode terminal parts 41A to 45A. That is, the heating values of the heating parts 40A, 40J nearest to the electrode terminal parts 41A to 45A become the highest, and the heating values of the heating parts 40E, 40F farthest from the electrode terminal parts 41A to 45A (near the axial center) become the lowest. As a result, a temperature of the both ends in the axial direction of the heater 23 becomes high, and a temperature around the center thereof becomes low (cf. a dashed and single-dotted line in FIG. 5). As described above, there is a case in which non-uniform heating in the heater 23 makes a temperature of the fixing belt 21 uneven along the axial direction and thus the fixing processing cannot be executed appropriately.

Consequently, with respect to the heater 23 of the fixing device 7 in accordance with the first embodiment, sizes of the heating parts 40A to 40J in the passing direction are set to gradually decrease with separating from the electrode terminal parts 41A to 45A (see FIG. 3). That is, total sums of the electrical resistances of the electrode terminal parts 41A to 45A and the heating parts 40A to 40J are adjusted to be substantially equal in all of the paths. Thereby, the heating values of the heating parts 40A to 40J, that is, the temperatures of the heater 23 become to be substantially uniform over the axial direction, which enables to heat the fixing belt 21 substantially uniformly over the axial direction (cf. a solid line in FIG. 5)

Subsequently, the temperature sensor detects the surface temperature of the fixing belt 21 and transmits a detection signal to the control device via input circuitry. When receiving the detection signal from the temperature sensor indicating that the surface temperature has reached setting temperature (i.e., 150 degree Celsius to 200 degree Celsius), the control device initiates to execute the image forming process explained above with controlling the heater 23 so as to maintain the setting temperature. The sheet S to which the toner image is transferred enters the housing 20. The fixing belt 21, with forwardly rotating around its axis, heats the toner (the toner image) on the sheet S passing through the pressing area N. The pressing roller 22, with rotating around its axis, presses the toner on the sheet S passing through the pressing area N. Consequently, the toner image is fixed on the sheet S. The sheet S on which the toner image is fixed, is forwarded out from the housing 20 and ejected to the sheet ejecting tray 4 (see FIG. 1). Note that the sheet S is conveyed in a condition that the center thereof in the axial direction (the front-back width) is aligned with the center of the fixing belt 21 in the axial direction.

A switch is provided in circuitry around the power source 17 (not shown). When the power source 17 and the discrete wiring parts 42, 43 are disconnected by the switch, the heating parts 40A to 40C and the heating parts 40H to 40J do not carry an electric current and are not be heated. Thereby, only the heating parts 40D to 40G can be heated and thus the range corresponding to the small size (neat the axial center can be heated.

With respect to the above-described heater 23 of the fixing device in accordance with the first embodiment, the sizes of the ten heating parts 40A to 40J in the passing direction (i.e., the second direction) are configured to gradually decrease with separating from the electrode terminal parts 41A to 45A (see FIG. 3). According to the above configuration, the resistance values of the heating parts 40E, 40F distant from the electrode terminal parts 41A to 45A can be reduced compared to the resistance values of the heating parts 40A, 40J close to the electrode terminal parts 41A to 45A. Thereby, it can be restrained that the heating values (temperatures) of the heating parts 40A to 40J decrease with separating from the electrode terminal parts 41A to 45A due to the voltage drop in the wiring parts 41 to 45. As a result, without adjusting the electrical resistances based on the wiring parts 41 to 45 in which modification during production is difficult, the non-uniform heating in the axial direction (i.e., the first direction) can be restrained by a simple configuration such as adjusting the sizes in the passing direction of the heating part 40A to 40J.

Furthermore, with respect to the heater 23 in accordance with the first embodiment, either all of the heating parts 40A to 40J or only the heating parts 40D to 40G can be fed. Thereby, the ranges corresponding to the sizes of the sheet S can be heated, which enables to reduce power consumption. Moreover, only the range corresponding to the small-sized sheet S (near the axial center) can be heated in the fixing belt 21, which enables to restrain overheating of both ends in the axial direction of the fixing belt 21.

Furthermore, with respect to the heater 23 in accordance with the first embodiment, since the wiring parts 41 to 45 extend from the both sides in the axial direction toward the center, the lengths of the wiring parts 41 to 45 (the conductive paths 41B to 45B) can be shortened, compared to extending the wiring parts 41 to 45 from a single side in the axial direction. Thereby, the voltage drop in the wiring parts 41 to 45 can be restrained.

Second Embodiment

Figure 6:
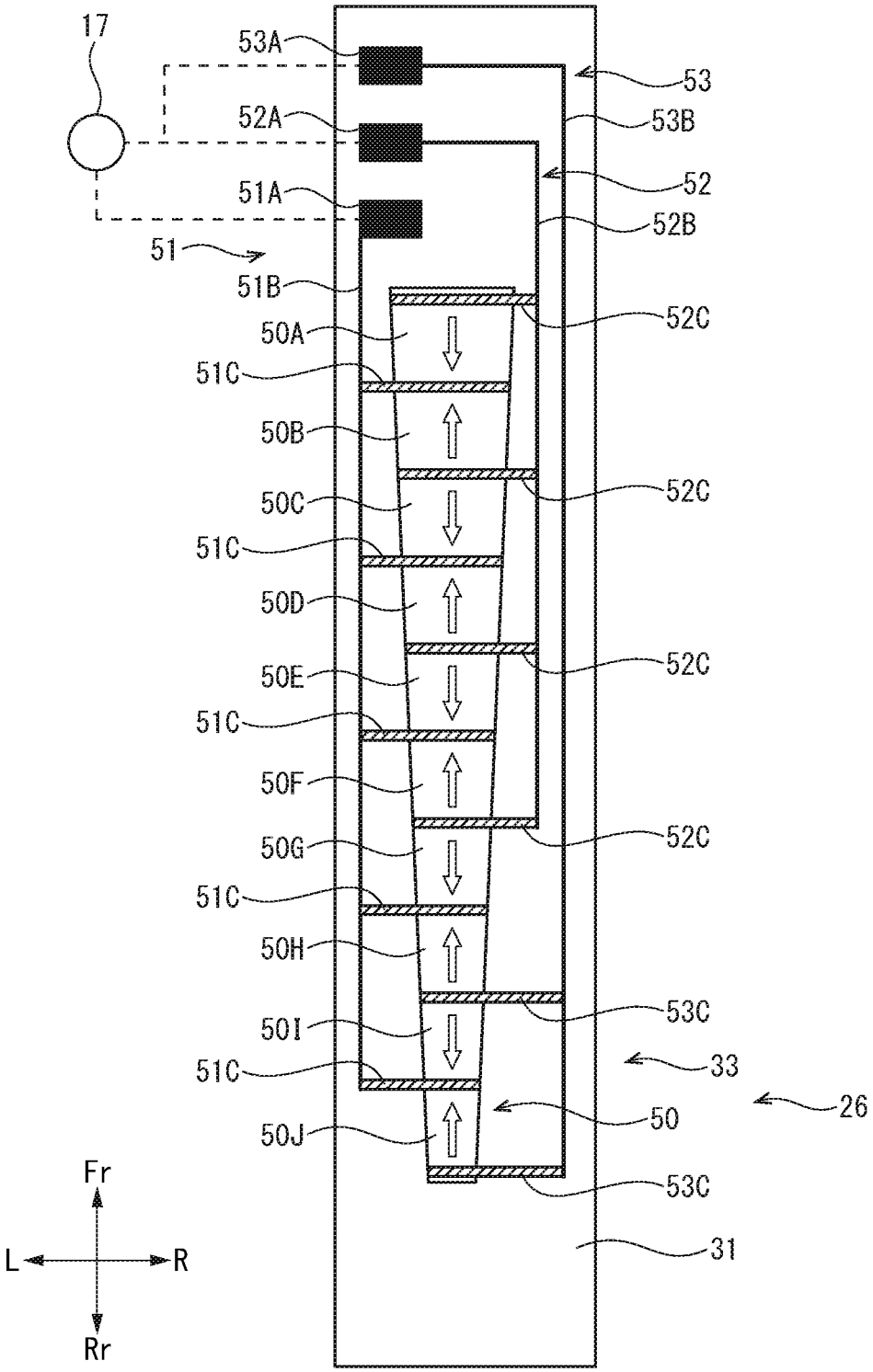
FIG. 6 is a bottom view that schematically shows a heater in accordance with a second embodiment of the present disclosure.

Subsequently, with reference to FIG. 6, a heater 26 of the fixing device 7 in accordance with a second embodiment will be explained. FIG. 6 is a bottom view that schematically shows the heater 26. Note that elements corresponding to those in the heater 23 (the fixing device 7) in accordance with the first embodiment are referred to using the same reference marks, and explanations on the same or corresponding elements in the heater 23 will be omitted hereinafter.

With respect to the fixing device 7 in accordance with the first embodiment, the heater 23 is the two-sided power supply type in which the electrode terminal parts 41A to 45A are arranged on the both sides in the axial direction. In contrast, with respect to the fixing device 7 in accordance with the second embodiment, it is different that the heater 26 is a one-sided power supply type in which the electrode terminal parts 51A to 53A are arranged on one side in an axial direction. In other words, the heater 26 has a shape formed by cutting the heater 23 in half from the center in the axial direction.

(Heating and Contacting Part)

A heating and contacting part 33 of the heater 26 includes a heating layer part 50, a common wiring part 51, two discrete wiring parts 52, 53, and a coat layer 46 (see FIG. 4).

(Heating Layer Part)

The heating layer part 50 has a shape narrowing in width of a passing direction gradually from one side (i.e., a front side) in the axial direction to the other side (i.e., a back side) in the axial direction. For example, the heating layer part 50 has a length in the axial direction in which the entire area of the sheet S of A4 size can be heated.

(Wiring Part)

The common wiring part 51 is mostly located on an upstream side (i.e., a left side) of the heating layer part 50. The discrete wiring parts 52, 53 are mostly located on a downstream side (i.e., a right side) of the heating layer part 50.

The common wiring part 51 includes an electrode terminal part 51A, a conductive path 51B, and five branching paths 51C. The discrete wiring part 52 includes an electrode terminal part 52A, a conductive path 52B, and four opposite branching paths 52C. The discrete wiring part 53 includes an electrode terminal part 53A, a conductive path 53B, and two opposite branching path 53C.

The electrode terminal parts 51A to 53A are arranged on the one side (i.e., the front side) in the axial direction than the heating layer part 50. The electrode terminal parts 51A to 53A are arranged in this order at substantially the same intervals from the heating layer part 40 toward an outside in the axial direction. The electrode terminal part 51A is electrically connected to one terminal of a power source 17, and the electrode terminal parts 52A, 53A are electrically connected to the other terminal of the power source 17.

The conductive path 51B is provided on the upstream side (i.e., the left side) of the heating layer part 50 to be elongated from the electrode terminal part 51A toward the other side (i.e., the back side) in the axial direction. The conductive paths 52B, 53B are provided on the downstream side (i.e., the right side) of the heating layer part 50 to be elongated backwardly from the electrode terminal parts 52A, 53A. The conductive path 53B is located on the right side of the conductive path 52B, and is elongated backwardly longer than the conductive path 52B.

The five branching paths 51C are arranged at substantially the same intervals in the axial direction, elongated from the conductive path 51B toward the downstream side, and connected on the heating layer part 50. The opposite branching paths 52C are arranged at substantially the same intervals in the axial direction, elongated from the conductive path 52B toward the upstream side, and connected on the heating layer part 50. The opposite branching paths 53C are arranged at substantially the same intervals in the axial direction behind the rearmost opposite branching path 52C, elongated from the conductive path 53B toward the upstream side, and connected on the heating layer part 50. The five branching paths 51C and the six opposite branching paths 52C, 53C are laminated alternately and at substantially the same intervals, and partition the heating layer part 50 into ten heating parts 50A to 50J.

(Heating Part)

The ten heating parts 50A to 50J are arranged in a line in this order from the front side toward the back side. Sizes of the ten heating parts 50A to 50J in the passing direction are set to gradually decrease with separating from the electrode terminal parts 51A to 53A in the axial direction. For example, using the maximum length in the passing direction of the heating part 50A as a base of 100%, a length of the axial center of the heating layer part 50 (i.e., between the heating part 50E and the heating part 50F) is set to approximately 98%, and a minimum length in the passing direction of the heating part 50J is set to approximately 97%. The heating parts 50A to 50G that are located on the one side (i.e., the front side) in the axial direction are provided corresponding to the range of the small sheet S. All of the heating parts 50A to 50J are provided corresponding to the range of the regular sheet S. Note that the sheet S is conveyed in a condition that the front end thereof is aligned with the front end of the fixing belt 21.

If all of the heating parts 50A to 50J are in the same size, a heating value in each of the heating parts 50A to 50J gradually decreases with separating from the electrode terminal parts 51A to 53A. As a result, a temperature of one end (i.e., a front end) in the axial direction of the heater 26 becomes high, and a temperature of the other end (i.e., a back end) in the axial direction thereof becomes low (cf. a dashed and double-dotted line in FIG. 5). In that respect, according to the above-described heater 26 of the fixing device 7 in accordance with the second embodiment, substantially the same operations and effects as those of the heater 23 in accordance with the above-described first embodiment can be obtained, such as the non-uniform heating in the axial direction can be restrained by a simple configuration such as adjusting the sizes in the passing direction of the heating part 50A to 50J (cf. the solid line in FIG. 5).

Third Embodiment

Figure 7:
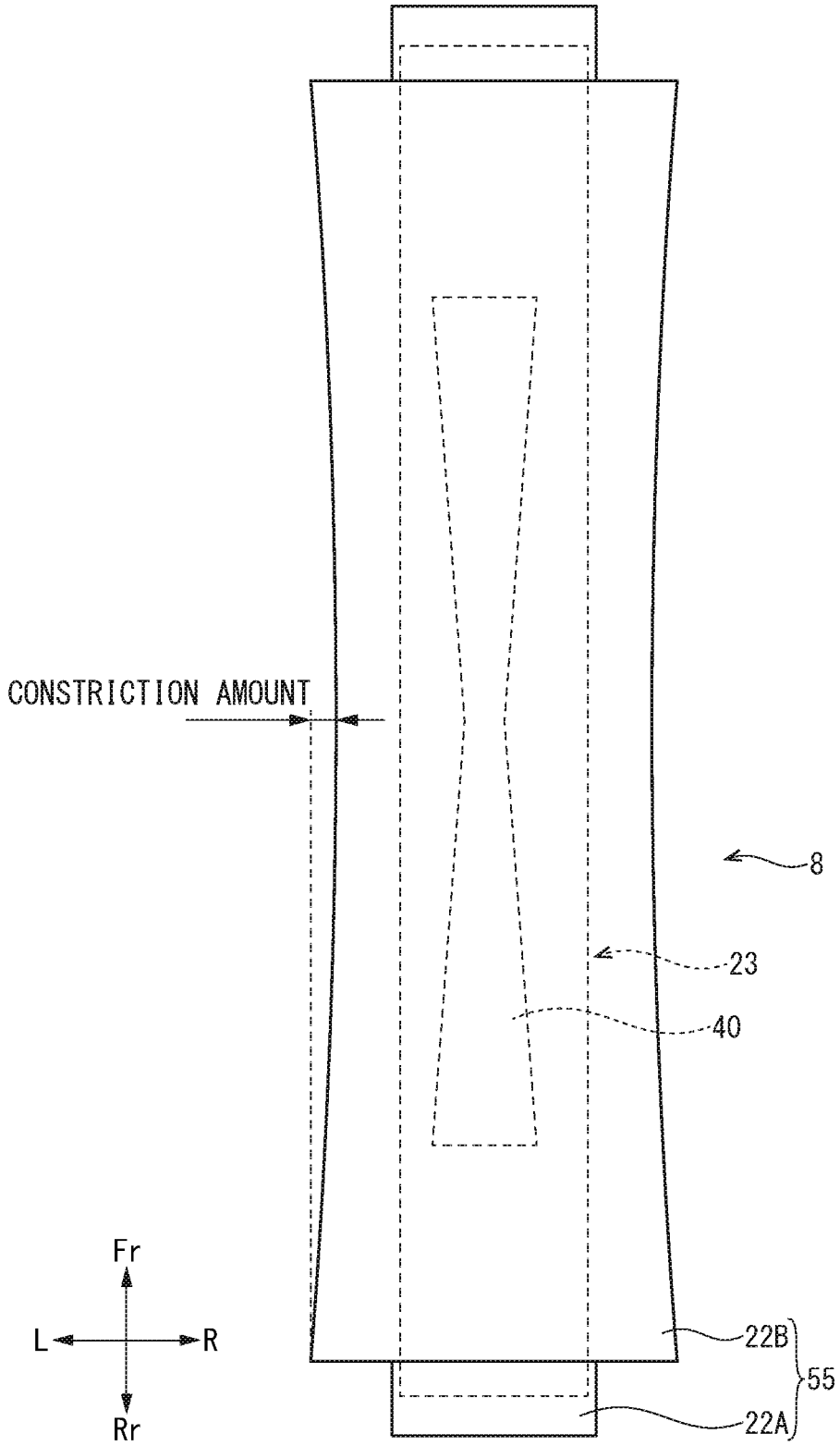
FIG. 7 is a plan view that schematically shows a pressing roller and other elements of a fixing device in accordance with a third embodiment of the present disclosure.

Subsequently, with reference to FIG. 7, a fixing device 8 in accordance with a third embodiment will be explained. FIG. 7 is a plan view that schematically shows a pressing roller 55 and other elements of the fixing device 8. Note that elements corresponding to those in the fixing device 7 in accordance with the first embodiment are referred to using the same reference marks, and explanations on the same or corresponding elements in the fixing device 7 will be omitted hereinafter.

With respect to the fixing device 8 in accordance with the third embodiment, a heater 23 has a plurality of (i.e., ten) heating parts 40A to 40J, and sizes of the plural heating parts 40A to 40J in a passing direction are set to gradually decrease from both sides in an axial direction toward a center (see FIG. 3).

A point of difference between the fixing device 8 and the fixing device 7 in accordance with the first embodiment is that the pressing roller 55 has a shape constricted near the substantial center in the axial direction (hereinafter also referred to as an "inverted crown shape"). A diameter (an external diameter) of the pressing roller 55 is set to decrease gradually from the both ends in the axial direction toward the center. For example, a diameter difference (i.e., a constriction amount) between the both ends and the center in the axial direction of the pressing roller 55 is set to approximately 0.1 mm to 0.2 mm. The pressing roller 55 with the inverted crown shape produces a force that pulls the sheet S passing through the pressing area N outside in the axial direction, which can restrain from wrinkling the sheet S passing through the pressing area N.

Incidentally, in the fixing device 8 using the pressing roller 55 with the inverted crown shape, a pressurizing width (a length in the passing direction) of the pressing area N gradually narrows (becomes short) from the both ends toward the center in the axial direction. Pressure in the pressing area N drops near the center in the axial direction than the both sides in the axial direction. Consequently, a temperature at the both sides in the axial direction of the fixing belt 21 becomes higher than that near the center in the axial direction.

In that respect, in the heater 23 of the fixing device 8 in accordance with the third embodiment, the sizes of the heating parts 40A to 40J in the passing direction are configured to gradually decrease with separating from the electrode terminal parts 41A to 45A (see FIG. 3). For example, using the maximum length in the passing direction of the heating parts 40A, 40J as a base of 100%, a length of the passing direction at the axial center of the heating layer part 40 is set to approximately 92% to 95%. Note that it is preferable that size differences in the passing direction between the heating parts 40A to 40J increase with increasing the constriction amount of the pressing roller 55.

With respect to the heater 23 in the fixing device 8 in accordance with the third embodiment, the sizes in the passing direction of the ten heating parts 40A to 40J gradually decrease with approaching from the both ends toward the center in the axial direction, which can restrain the temperature drop near the center in the axial direction of the heating layer part 40 due to the voltage drop. Thereby, the temperature differences between the both sides and vicinity of the center in the axial direction of the pressing area N can be reduced in spite of the fixing device 8 using the pressing roller 55 with the inverted crown shape. As a result, the uneven heating in the axial direction of the heater 23 can be restrained, and thus the fixing belt 21 can be heated substantially uniformly over the axial direction.

Fourth Embodiment

Figure 8:
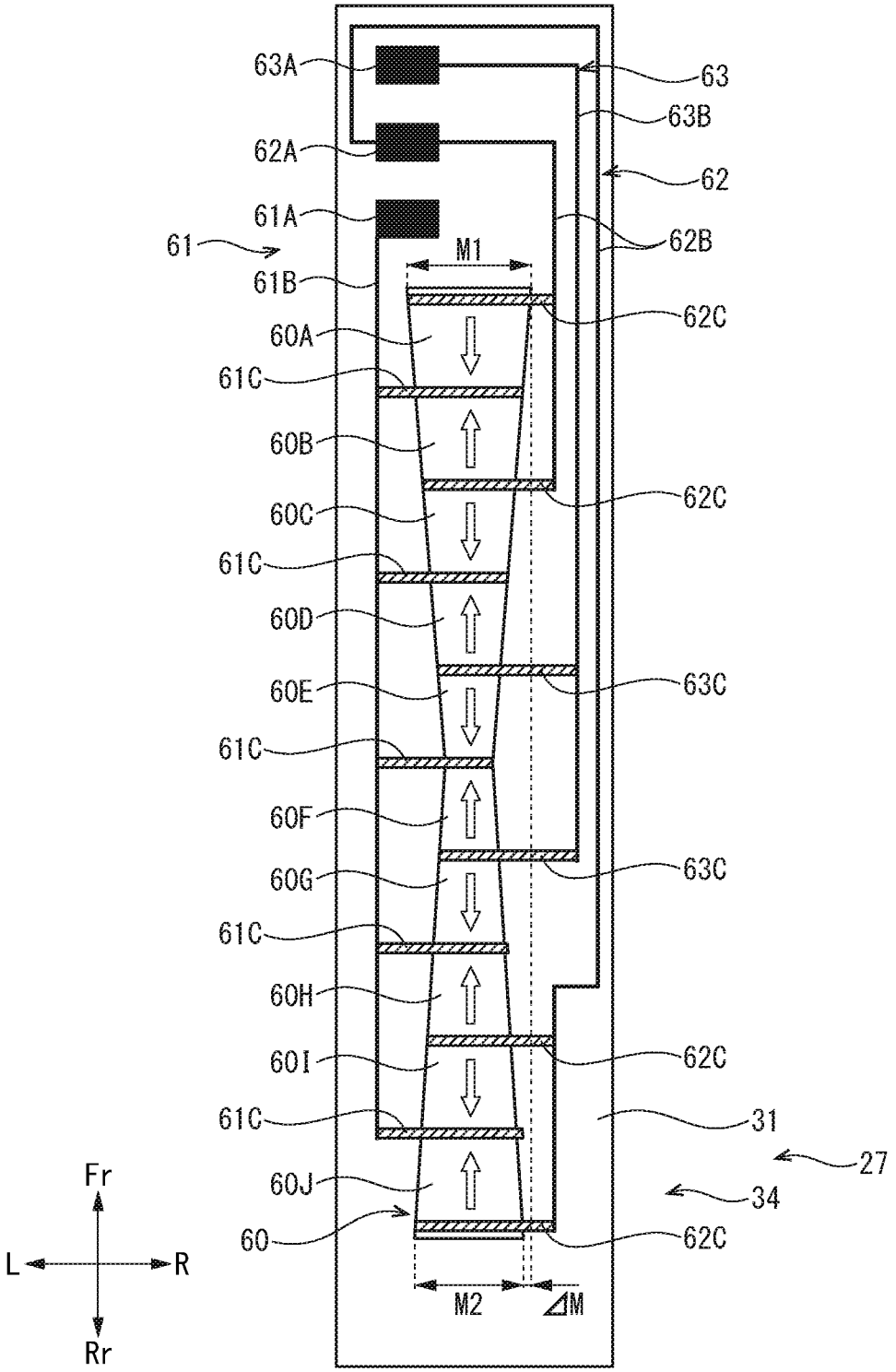
FIG. 8 is a bottom view that schematically shows a heater in accordance with a fourth embodiment of the present disclosure.

Subsequently, with reference to FIG. 8, a fixing device 8 in accordance with a fourth embodiment will be explained. FIG. 8 is a bottom view that schematically shows a heater 27. Note that elements corresponding to those in the heater 23, 26 (the fixing device 7, 8) in accordance with the first to third embodiments are referred to using the same reference marks, and explanations on the same or corresponding elements in the fixing devices 7, 8 will be omitted hereinafter.

A point of difference is that the fixing device 8 in accordance with the third embodiment adopts the heater 23 with the two-sided power supply type, whereas the fixing device 8 in accordance with the fourth embodiment adopts the heater 27 with the one-sided power supply type. Since the fixing device 8 adopts the pressing roller 55 with the inverted crown shape, the heater 26 with the one-sided power supply type in accordance with the second embodiment cannot be applied to the fixing device 8. Consequently, in the fixing device 8 in accordance with the fourth embodiment, the heater 27 with one-sided power supply type being different from the heater 26 is adopted.

Heating and Contacting Part

A heating and contacting part 34 of the heater 27 includes a heating layer part 60, a common wiring part 61, two discrete wiring parts 62, 63, and a coat layer 46 (see FIG. 4).

(Heating Layer Part)

The heating layer part 60 has a shape narrowing in width of a passing direction gradually from both ends in an axial direction toward a center. One end (i.e., a front end) in the axial direction of the heating layer part 60 is formed to be slightly longer in the passing direction than the other end (i.e., a back end) in the axial direction thereof. For example, the heating layer part 60 has a length in the axial direction in which the entire area of the sheet S of A4 size can be heated.

(Wiring Part)

The common wiring part 61 is mostly located on an upstream side (i.e., a left side) of the heating layer part 60. The discrete wiring parts 62, 63 are mostly located on a downstream side (i.e., a right side) of the heating layer part 60.

The common wiring part 61 includes an electrode terminal part 61A, a conductive path 61B, and five branching paths 61C. The discrete wiring part 62 includes an electrode terminal part 62A, two conductive paths 62B, and four opposite branching paths 62C. The discrete wiring part 63 includes an electrode terminal part 63A, a conductive path 63B, and two opposite branching paths 63C.

The electrode terminal parts 61A to 63A are arranged on the one side (i.e., the front side) in the axial direction than the heating layer part 60. The electrode terminal parts 61A to 63A are arranged in this order at substantially the same intervals from the heating layer part 60 toward an outside in the axial direction. The electrode terminal part 61A is electrically connected to one terminal of a power source 17, and the electrode terminal parts 62A, 63A are electrically connected to the other terminal of the power source 17 (not shown in FIG. 8).

The conductive path 61B is provided on the upstream side (i.e., the left side) of the heating layer part 60 to be elongated from the electrode terminal part 61A toward the other side (i.e., the back side) in the axial direction. The two conductive paths 62B that bifurcate from the electrode terminal part 62A are provided on the downstream side (i.e., the right side) of the heating layer part 60 to be elongated from the front side toward the back side. The conductive path 63B is provided on the downstream side of the heating layer part 60 to be elongated from the electrode terminal part 63A toward the back side. The conductive path 63B is located between the two conductive paths 62B.

The five branching paths 61C are arranged at substantially the same intervals in the axial direction, elongated from the conductive path 61B toward the downstream side, and connected on the heating layer part 60. The four opposite branching paths 62C are elongated from the two conductive paths 62B toward the upstream side, and connected on the heating layer part 60. The two opposite branching paths 63C are elongated from the conductive path 63B toward the upstream side, and connected on the heating layer part 60. The five branching paths 61C and the six opposite branching paths 62C, 63C are laminated alternately and at substantially the same intervals, and partition the heating layer part 60 into ten heating parts 60A to 60J.

(Heating Part)

The ten heating parts 60A to 60J are arranged in a line in this order from the front side toward the back side. Sizes of the ten heating parts 60A to 60J in the passing direction are set to gradually decrease with approaching from the both ends in the axial direction toward the center in the axial direction. The heating parts 60D to 60G that are located near the center in the axial direction are provided corresponding to the range of the small sheet S. All of the heating parts 60A to 60J are provided corresponding to the range of the regular (e.g., A4-sized) sheet S. Note that the sheet S is conveyed in a condition that the center thereof in the axial direction (the front-back width) is aligned with the center of the fixing belt 21 in the axial direction.

A size in the passing direction of the heating part 60J located at the other end (i.e., the back end) in the axial direction (i.e., the maximum size M2) is set to be smaller than a size in the passing direction of the heating part 60A located at the one end (i.e., the front end) in the axial direction (i.e., the maximum size M1) (the difference $\Delta M = M1 - M2$). For example, using the maximum length in the passing direction of the heating part 60A as a base of 100%, a length of the passing direction at the axial center of the heating layer part 60 (i.e., between the heating part 60E and the heating part 60F) is set to approximately 92% to 95%, and the minimum length in the passing direction of the heating part 60J is set to approximately 97%. Note that it is preferable that size differences in the passing direction between the both ends and the center of the heating layer part 60 increase with increasing the constriction amount of the pressing roller 55.

With respect to the heater 27 in the fixing device 8 in accordance with the fourth embodiment, the sizes in the passing direction of the ten heating parts 60A to 60J gradually decrease with approaching from the both ends toward the center in the axial direction, and the size in the passing direction of the heating part 60J located at the back end in the axial direction is set to be smaller than the size in the passing direction of the heating part 60A located at the front end in the axial direction. Those configurations can restrain the temperature drop near the center in the axial direction of the heating layer part 60 due to the voltage drop. Thereby, the temperature differences between the one end (i.e., the front end) and vicinity of the center in the axial direction of the pressing area N can be reduced in spite of the fixing device 8 using the pressing roller 55 with the inverted crown shape. Furthermore, while the heating value becomes low in the back end of the heating layer part 60 due to the voltage drop, the temperature in the back end of the pressing area N can be increased owing to the inverted crown shape in the pressing roller 55. Thereby, the pressing area N can be set to the temperature substantially uniform over the axial direction in spite of the fixing device 8 using the pressing roller 55 with the inverted crown shape and the heater 27 with the one-sided power supply type.

Figure 9:
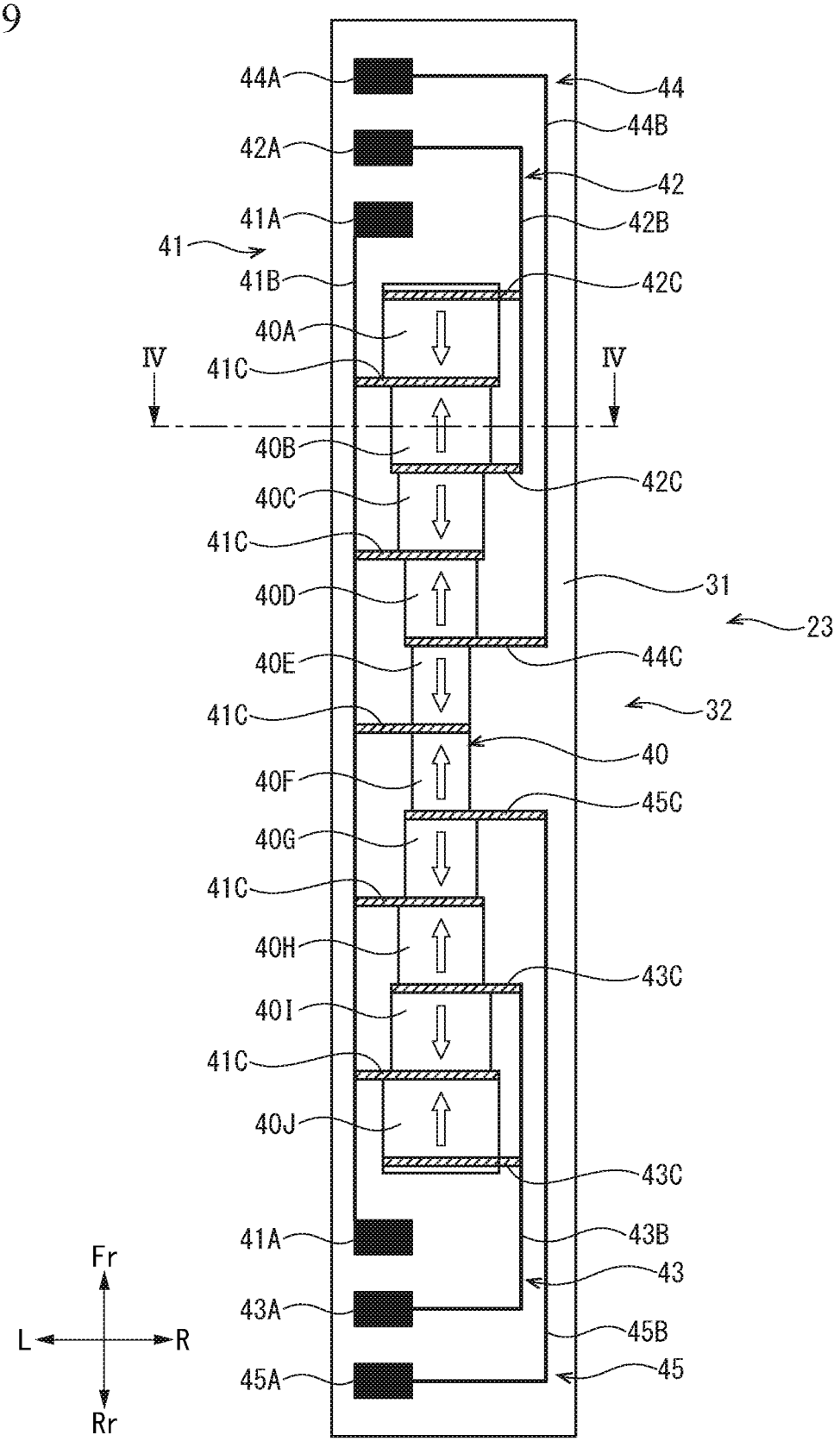
FIG. 9 is a bottom view that schematically shows a heater in accordance with a variation of the first embodiment of the present disclosure.

Note that the present disclosure is not limited to the configurations that the sizes in the passing direction of the heating parts 40A to 40J, 50A to 50J, and 60A to 60J gradually decrease with separating from the electrode terminal parts 41A to 45A, 51A to 53A, and 61A to 63A in the heater 23, 26, 27 in accordance with the first to fourth embodiments. For example, as shown in FIG. 9, the sizes in the passing direction of the heating parts 40A to 40J etc. may be set to decrease stepwisely (i.e., in a staircase pattern) with separating in the axial direction from the electrode terminal parts 41A to 45A etc.

The present disclosure is not limited to the heater 23, 26, 27 in which the ten heating parts 40A to 40J etc. are formed in accordance with the first to fourth embodiments. For example, the branching path(s) may be formed so as to form at least two heating parts (not shown).

Fifth Embodiment

Figure 10:
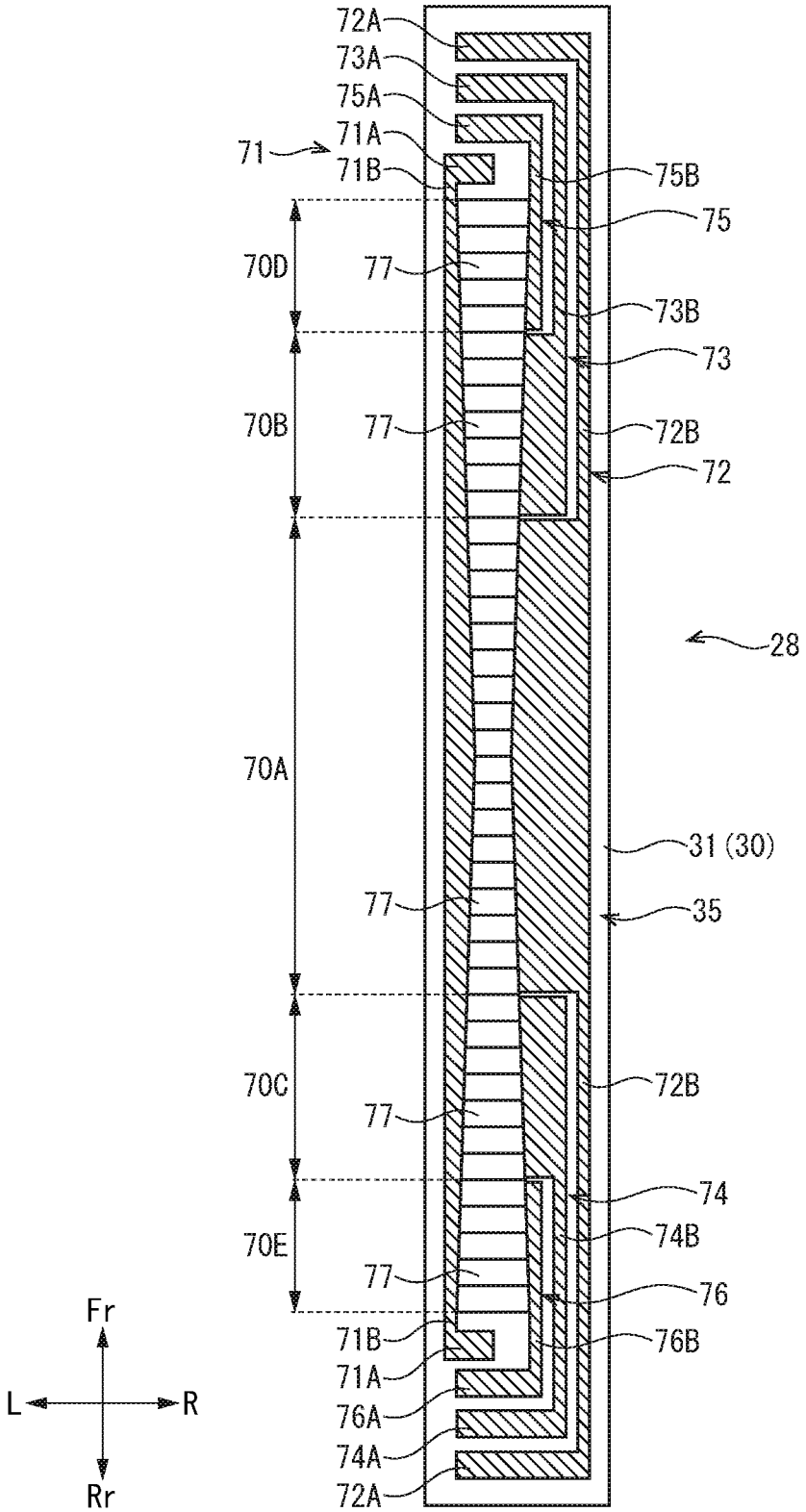
FIG. 10 is a bottom view that schematically shows a heater in accordance with a fifth embodiment of the present disclosure.

Subsequently, with reference to FIG. 10, a heater 28 of a fixing device 7 in accordance with a fifth embodiment will be explained. FIG. 10 is a bottom view that schematically shows the heater 28. Note that elements corresponding to those in the heater 23, 26, 27 (the fixing device 7, 8) in accordance with the first to fourth embodiments are referred to using the same reference marks, and explanations on the same or corresponding elements in the heater 23 etc. will be omitted hereinafter.

A point of difference is that a plurality of the heating parts 40A to 40J etc. are configured by partitioning the heating layer part 40, 50, 60 using a plurality of the branching paths 41C to 45C with respect to the heater 23, 26, 27 in accordance with the first to fourth embodiments, whereas each of heating parts 70A to 70E is configured with a plurality of heating resistors 77 arranged in a line in an axial direction (i.e., a first direction) with respect to the heater 28 in accordance with the fifth embodiment.

Heating and Contacting Part

A heating and contacting part 35 of the heater 28 includes five heating parts 70A to 70E, a common wiring part 71, five discrete wiring parts 72 to 76, and a coat layer 46 (see FIG. 4).

(Heating Part)

The five heating parts 70A to 70E are formed to be arranged in line in the axial direction. Each of the heating parts 70A to 70E is configured with a plurality of the heating resistors arranged in line in the axial direction. In detail, the heating part 70A located at a center in the axial direction is configured with a plurality of the heating resistors 77 arranged in a range corresponding to a front-back width of a small (e.g., A5-sized) sheet S passing through the pressing area N. The two heating parts 70B, 70C located on the both sides in the axial direction of the heating part 70A are configured with a plurality of the heating resistors 77 arranged in a range corresponding to a front-back width of a middle (e.g., B5-sized) sheet S passing through the pressing area N. The two heating parts 70D, 70E located on the both sides in the axial direction of the heating parts 70B, 70C are configured with a plurality of the heating resistors 77 arranged in a range corresponding to a front-back width of a regular (e.g., A4-sized) sheet S passing through the pressing area N.

The five heating parts 70A to 70E are shaped to narrow in width of a passing direction gradually from the both ends in the axial direction toward the center. Each of the heating resistors 77 included in the heating parts 70A to 70E is formed to be a substantially trapezoidal shape that is elongated in the passing direction and that is narrower in the passing direction at the center side than at the outer side in the axial direction. Regarding the substantially trapezoidal shape, the heating resistor 77 located on the center side is shorter in the passing direction than the heating resistor 77 located on the outer side in the axial direction. In detail, for example, using the maximum length in the passing direction of the heating resistors 77 located on the both ends in the axial direction, a length in the passing direction of the heating resistor 77 located on the axial center is set to approximately 98%. The heating resistors 77 are formed in the same size in the axial direction. In the present specification, "the same size" does not mean completely the same size, but means allowing a venial error in production.

Each of the heating resistors 77 is formed to have a size ratio (L/W) of the size in the passing direction to the size in the axial direction being set to 1 or more and 100 or less. Concretely, the length (L) of the heating resistors 77 may be set in a range of 3 mm or more and 20 mm or less, on grounds of manufacturing easiness, a maximum length of the pressing area N, and so forth. The width (W) of the heating resistors 77 may be set in a range of 0.2 mm or more and 5 mm or less, on grounds of manufacturing easiness, the size ratio (L/W), and so forth.

(Wiring Part)

The common wiring part 71 is commonly connected to each upstream end (one end in the passing direction) of the five heating parts 70A to 70E. The five discrete wiring parts 72 to 76 are discretely connected to respective downstream ends (the other ends in the passing direction) of the five heating parts 70A to 70E. The wiring parts 71 to 76 respectively have conductive paths 71B to 76B that are elongated from portions connected to the heating parts 70A to 70E toward positions outside the heating parts 70A to 70E in the axial direction, and electrode terminal parts 71A to 76A that are continuous with tips of the conductive paths 71B to 76B. The electrode terminal parts 71A to 76A are arranged outside the heating parts 70A to 70E in the axial direction. The conductive paths 71B to 76B respectively connect the heating parts 70A to 70E and the electrode terminal parts 71A to 76A.

In detail, the conductive paths 71B of the common wiring part 71 extend from connecting portions to the heating parts 70A to 70E toward the both sides in the axial direction. The pair of the electrode terminal parts 71A bend from the both ends of the conductive paths 71B toward the downstream side (i.e., the right side). On the other hand, the conductive paths 72B of the discrete wiring part 72 extend from connecting portions to the heating part 70A toward the both sides in the axial direction. The pair of the electrode terminal part 72A bend from the both ends of the pair of the conductive paths 72B toward the upstream side (i.e., the left side). The conductive paths 73B, 75B of the discrete wiring parts 73, 75 and the conductive paths 74B, 76B of the discrete wiring parts 74, 76 respectively depart from connecting portions to the heating parts 70B to 70E to extend outside the axial direction. The electrode terminal parts 73A to 76A bend from the tips of the conductive paths 73B to 76B toward the upstream side. The electrode terminal parts 73A, 74A are located inward in the axial direction from the pair of the electrode terminal parts 72A. The electrode terminal parts 75A, 76A are located inward in the axial direction from the electrode terminal parts 73A, 74A. The pair of the electrode terminal parts 71A are located inward in the axial direction from the electrode terminal parts 75A, 76A.

In the heater 28, the heating resistors 77 are heated by electric current flowing between the common wiring part 71 and the discrete wiring parts 72 to 76 in the passing direction.

According to the above-described heater 28 in accordance with the fifth embodiment, substantially the same operations and effects as those of the heater 23 in accordance with the above-described first embodiment and so forth can be obtained.

Figure 11:
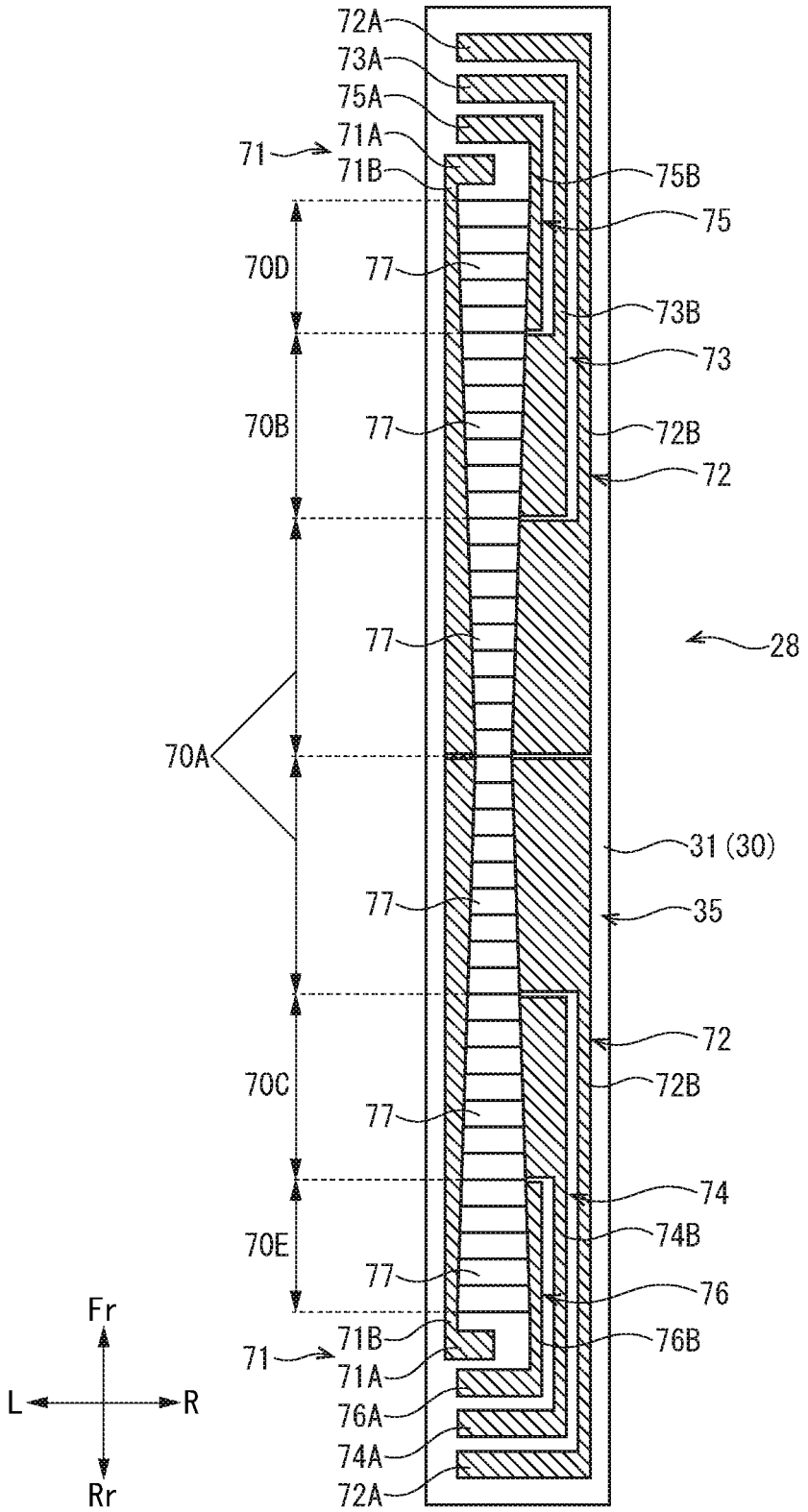
FIG. 11 is a bottom view that schematically shows a heater in accordance with a variation of the fifth embodiment of the present disclosure.

The present disclosure in not limited to the configurations that the single common wiring part 71 and the single discrete wiring part 72 are connected to the single heating part 70A in the heater 28 in accordance with the fifth embodiment. For example, as shown in FIG. 11, the heating part 70A may be divided into halves, each of the common wiring part 71 and the discrete wiring part 72 may be divided into two so as to respectively connect to the halves of the heating part 70A.

The heater 28 in accordance with the fifth embodiment is applied to the fixing device using the cylindrical pressing roller 22. Alternatively, the heater 28 may be applied to the fixing device 8 using the pressing roller 55 with the inverted crown shape.

Sixth Embodiment

Figure 12:
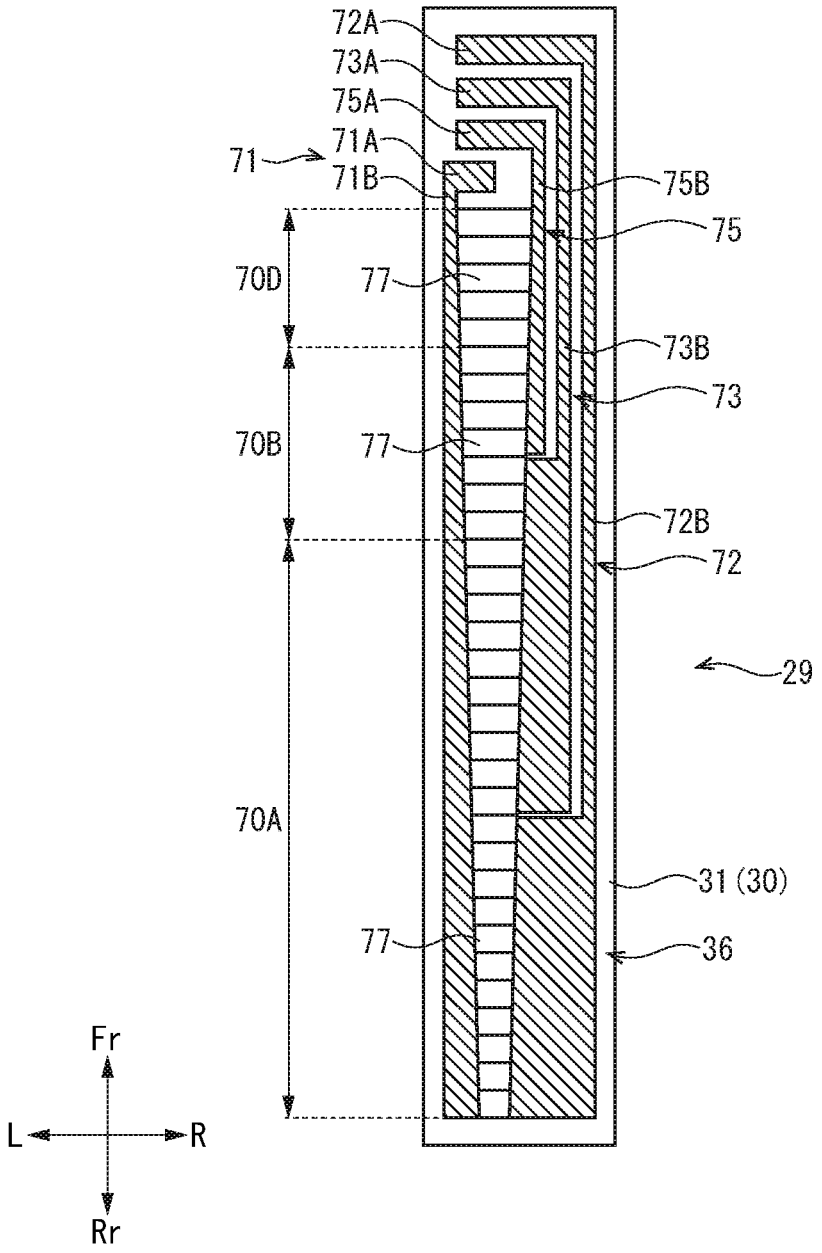
FIG. 12 is a bottom view that schematically shows a heater in accordance with a sixth embodiment of the present disclosure.

Subsequently, with reference to FIG. 12, a heater 29 of a fixing device 7 in accordance with a sixth embodiment will be explained. FIG. 12 is a bottom view that schematically shows the heater 29. Note that elements corresponding to those in the heater 28 in accordance with the fifth embodiment are referred to using the same reference marks, and explanations on the same or corresponding elements in the heater 28 will be omitted hereinafter.

A point of difference is that the heater 28 in accordance with the fifth embodiment is the two-sided power supply type, whereas the heater in accordance with the sixth embodiment is a one-sided power supply type. In other words, the heater 29 has a shape formed by cutting the heater 28 in half from the center in the axial direction.

A heating and contacting part 36 of the heater 29 includes three heating parts 70A, 70B, 70C, a common wiring part 71, three discrete wiring parts 72, 73, 75, and a coat layer 46 (see FIG. 4). That is, in the heating and contacting part 36 in the heater 29, the heating parts 70C, 70E, and the two discrete wiring parts 74, 76 are omitted. According to the above configuration, since electrode terminal parts 71A, 72A, 73A, 75A and external devices such as a power source can be connected at a single site, the heater 29 can be downsized.

Note that the heater 29 of the one-sided power supply type in accordance with the sixth embodiment cannot be applied to the fixing device 8 using the pressing roller 55 with the inverted crown shape. Accordingly, the same technical idea regarding the heater 27 in accordance with the fourth embodiment (see. FIG. 8) may be adopted so that the heater 28 in accordance with the fifth embodiment may be changed to the one-sided power supply type in order to be applied to the fixing device 8 using the pressing roller 55 with the inverted crown shape (a seventh embodiment: not shown).

It is not limited to the configurations that the sizes in the passing direction of the heating parts 70A to 70E (the heating resistors 77) decrease gradually with separating from the electrode terminal parts 71A to 76A. Alternatively, the sizes may be set to decrease stepwisely (i.e., in a staircase pattern) (not shown).

The present disclosure in not limited to the configurations that the heating parts 40A to 40J etc. of the heater 23, 26, 27 in accordance with the first to fourth embodiments are located so as to correspond to the two sizes of the sheets S, and that the heating parts 70A to 70E etc. in the heater 28, 29 in accordance with the fifth to seventh embodiments are located so as to correspond to the three sizes of the sheet S. The wiring parts and the heating parts (the heating layer part) may be provided so as to correspond to a single size of the sheet S or may be provided so as to correspond to three or more sizes of the sheets S.

With respect to the fixing device 7, 8 in accordance with the first to fourth embodiments, the pressing roller 22, 55 is rotatively driven and the fixing belt 21 is rotated by following the pressing roller. Alternatively, the fixing belt 21 may be rotatively driven and the pressing roller 22, 55 may be is rotated by following the fixing belt.

With respect to the fixing device 7, 8 in accordance with the first to fourth embodiments, the pressing roller 22, 55 is raised and lowered against (moved to a direction to approach or a direction to separate from) the fixing belt 21. Nevertheless, the present disclosure is not limited to this configuration. Alternatively, the fixing belt 21 may be moved to a direction to approach or a direction to separate from the pressing roller 22, 55.

In the above description regarding the present embodiments, it is exemplified that the disclosure is applied to the monochrome printer 1. Alternatively, for instance, the disclosure may be applied to a color printer, a copying machine, a facsimile, or a multifunction peripheral and so forth.

Note that the above description regarding the present embodiments merely shows one aspect in the heating unit, the fixing device, and image forming apparatus in accordance with the present disclosure. The scope of the present disclosure is not limited to the above-described embodiments.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A heating unit comprising:

a circuit board;

a plurality of heating parts provided to be arranged in a first direction on a surface of the circuit board; and a plurality of wiring parts provided on the surface of the circuit board and electrically connecting the heating parts and a power source to feed the heating parts, wherein the wiring parts respectively include electrode terminal parts electrically connected to the power source outside the heating parts in the first direction, and wherein sizes in a second direction orthogonal to the first direction of three or more of the heating parts are set to decrease gradually or stepwisely with separating in the first direction from the electrode terminal parts, a total sum of electrical resistances of each heating part and the wiring part connected to each heating part is adjusted to be equal among paths for the plurality of heating parts.

2. The heating unit according to claim 1, wherein the electrode terminal parts of the wiring parts sandwich the heating parts and are arranged on both outsides in the first direction of the heating parts, and wherein the sizes in the second direction of the heating parts are set to decrease gradually or stepwisely from both ends in the first direction toward a center in the first direction.

3. A fixing device comprising:

a fixing member configured to heat toner on a medium with rotating around an axis thereof;

a pressing member configured to, with rotating around an axis thereof, form a pressing area with the fixing member and press the toner on the medium passing through the pressing area; and a heating unit according to claim 2, and configured to be provided opposite to the pressing member across the fixing member and heat the fixing member, wherein a diameter of the pressing member is set to decrease gradually from both ends in an axial direction toward a center.

4. The fixing device according to claim 3, wherein the wiring parts include a common wiring part commonly connected to the heating parts from one side in a passing direction of the heating parts and a plurality of discrete wiring parts discretely connected to the heating parts from another side in the passing direction of the heating parts, wherein the common wiring part and the discrete wiring parts respectively include conductive paths that connect branching paths elongated in the passing direction to be connected to the heating parts with the electrode terminal parts, wherein the branching paths of the common wiring part and the discrete wiring parts are alternately arranged to dividedly form the heating parts, and wherein electric potential differences are generated between the branching paths, which causes electric current flows in opposite directions at the heating parts neighboring across each of the branching paths.

5. The fixing device according to claim 3, wherein each of the heating parts is configured with a plurality of heating resistors arranged in the axial direction, wherein the wiring parts include a common wiring part commonly connected to each one end in a passing direction of the heating parts and a plurality of discrete wiring parts discretely connected to respective another ends in the passing direction of the heating parts, wherein the common wiring part and the discrete wiring parts respectively include conductive paths that respectively connect the heating parts and the electrode terminal parts, and wherein the heating resistors are heated by electric current flowing between the common wiring part and the discrete wiring parts in the passing direction.

6. The heating unit according to claim 1, wherein the wiring parts include a common wiring part commonly connected to the heating parts from one side in the second direction of the heating parts and a plurality of discrete wiring parts discretely connected to the heating parts from another side in the second direction of the heating parts, wherein the common wiring part and the discrete wiring parts respectively include conductive paths that connect branching paths elongated in the second direction to be connected to the heating parts with the electrode terminal parts, wherein the branching paths of the common wiring part and the discrete wiring parts are alternately arranged to dividedly form the heating parts, and wherein electric potential differences are generated between the branching paths, which causes electric current flows in opposite directions at the heating parts neighboring across each of the branching paths.

7. The heating unit according to claim 1, wherein each of the heating parts is configured with a plurality of heating resistors arranged in the first direction, wherein the wiring parts include a common wiring part commonly connected to each one end in the second direction of the heating parts and a plurality of discrete wiring parts discretely connected to respective another ends in the second direction of the heating parts, wherein the common wiring part and the discrete wiring parts respectively include conductive paths that respectively connect the heating parts and the electrode terminal parts, and wherein the heating resistors are heated by electric current flowing between the common wiring part and the discrete wiring parts in the second direction.

8. A fixing device comprising:

a fixing member configured to heat toner on a medium with rotating around an axis thereof;

a pressing member configured to, with rotating around an axis thereof, form a pressing area with the fixing member and press the toner on the medium passing through the pressing area; and a heating unit according to claim 1, and configured to be provided opposite to the pressing member across the fixing member and heat the fixing member.

9. An image forming apparatus comprising a fixing device according to claim 8.

10. A fixing device comprising:

a fixing member configured to heat toner on a medium with rotating around an axis thereof;

a pressing member configured to, with rotating around an axis thereof, form a pressing area with the fixing member and press the toner on the medium passing through the pressing area; and a heating unit configured to be provided opposite to the pressing member across the fixing member and heat the fixing member, wherein a diameter of the pressing member is set to decrease gradually from both ends in an axial direction toward a center, the heating unit including:

a circuit board;

a plurality of heating parts provided to be arranged in the axial direction of the fixing member on a surface of the circuit board; and a plurality of wiring parts provided on the surface of the circuit board and electrically connecting the heating parts and a power source to feed the heating parts, wherein the wiring parts respectively include electrode terminal parts electrically connected to the power source outside the heating parts in the axial direction, wherein sizes in a passing direction orthogonal to the axial direction of three or more of the heating parts are set to decrease gradually or stepwisely from both ends in the axial direction toward a center in the axial direction, and wherein a size in the passing direction of a heating part located at another end in the axial direction is set to be smaller than a size in the passing direction of a heating part located at one end in the axial direction, a total sum of electrical resistances of each heating part and the wiring part connected to each heating part is adjusted to be equal among paths for the plurality of heating parts.

* * * * *